US005794091A

United States Patent [19]

Verlinden et al.

[11] Patent Number: 5,794,091

[45] Date of Patent: Aug. 11, 1998

[54] APPARATUS FOR THE WET PROCESSING OF PHOTOGRAPHIC SHEET MATERIAL

[75] Inventors: Bart Verlinden, Tongeren; Bart Verhoest, Wilrijk, both of Belgium

[73] Assignee: AGFA-Gevaert, Mortsel, Belgium

[21] Appl. No.: 764,856

[22] Filed: Dec. 13, 1996

[30] Foreign Application Priority Data

Dec. 13, 1995 [EP] European Pat. Off. ..... 95203464

[51] Int. Cl.[6] ..... G03D 3/08

[52] U.S. Cl. ..... 396/612

[58] Field of Search ..... 396/612, 614, 396/617, 620, 622; 492/28

[56] References Cited

U.S. PATENT DOCUMENTS

| | | | |
|---|---|---|---|
| 4,166,689 | 9/1979 | Schausberger et al. | 396/614 |
| 4,616,915 | 10/1986 | Norris | 396/617 |
| 5,049,915 | 9/1991 | Nakamura et al. | 396/622 |
| 5,108,878 | 4/1992 | Nakamura | 430/421 |
| 5,313,242 | 5/1994 | Devaney et al. | 396/617 |

OTHER PUBLICATIONS

Patent Abstracts of Japan JP-53117425, published 10/31/78, vol. 2, No. 149, p.77.

Patent Abstracts of Japan JP-53117426, published 10/13/78, vol. 2, No. 149, p. 77.

Patent Abstracts of Japan JP-59003435, published 01/10/84, vol. 8, No. 89, p. 270.

Patent Abstracts of Japan JP-63151944, published 06/24/88, vol. 12, No. 415, p. 781.

*Primary Examiner*—D. Rutledge

*Attorney, Agent, or Firm*—Baker & Botts, L.L.P.

[57] ABSTRACT

An apparatus for the wet processing of photographic sheet material comprises at least one treatment vessel having a rotatable endless surface means biased towards a reaction member to define a nip there-between through which the sheet material path extends. At least one of the endless rotatable surface means and the reaction member comprises an inner region (58) of elastomeric material having a relatively low hardness, and an outer region (60) of elastomeric material having a relatively high hardness positioned over the inner region (58). Such a roller minimises carry-over between vessels without damage to the sheet material while being capable of successfully being used as a drive roller. The roller exhibits good stability against treatment liquids and has good processing qualities.

15 Claims, 3 Drawing Sheets

APPARATUS FOR THE WET PROCESSING OF PHOTOGRAPHIC SHEET MATERIAL

FIELD OF THE INVENTION

The present invention relates to an apparatus for the wet processing of photographic sheet material, such as X-ray film, pre-sensitised plates, graphic art film and paper, and offset plates, and to a method of constructing a roller suitable for use in such an apparatus.

BACKGROUND OF INVENTION

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

In a conventional processing apparatus the sheet material is transported along a generally horizontal feed path, the sheet material passing from one vessel to another usually via a circuitous feed path passing under the surface of each treatment liquid and over dividing walls between the vessels.

In a system for the development of aluminium lithographic printing plates of the type disclosed in EP-A-410500 (Agfa Gevaert NV), the apparatus comprises a housing with pairs of processing rollers carried on roller shafts supported within the housing. The processing rollers are positioned substantially parallel and in line contact with each other. Means are provided for feeding photographic sheet material between the rollers.

The roller shafts are biased towards each other to exert a pressure on the photographic sheet material as it passes between the rollers.

Processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. As a consequence of the straight path, the material sensitivity to scratches becomes independent of the stiffness and thickness of the material.

In a vertically oriented apparatus, it is important to avoid, or at least minimise leakage of treatment liquid from one vessel to another and carry-over as the sheet material passes through the apparatus. U.S. Pat. No. 4,166,689 (Schausberger et al. assigned to Agfa-Gevaert AG) describes such an apparatus in which liquid escapes form the lower opening and is intercepted by the tank of a sealing device with two squeegees located in the tank above a horizontal passage in line with the lower opening. One or more pairs of drive rollers in the vessel close the lower opening and also serve to transport the sheet material along a vertical path which extends between the openings of the vessel.

In both such forms of processing apparatus, the rollers are used in pairs, biased towards each other, between which the sheet material passes to act as a seal between treatment vessels of the processing apparatus, that is to remove excess treatment liquid from the sheet as it passes from one treatment vessel to the next. This reduces carry-over of treatment liquid and thereby reduces contamination and wastage. A good removal of processing liquid is also required to reduce the drying time of the sheet material after the last process bath, and hence to reduce the energy use.

It is often convenient that these rollers also act as drive rollers, serving to advance the sheet material through the apparatus. To meet these demands successfully, the resilience of the rollers is important. Usually such rollers comprise a rigid core having a layer of, for example, elastomeric material positioned over the core. If the elastomeric material is too hard, the squeegeeing properties beyond the edges of the sheet material may not be optimum, resulting in an unacceptable level of carry-over. On the other hand, if the elastomeric material is too soft it will often contain oily materials which are liable to leach out of the elastomer and contaminate the sheet material, while the elastomeric material becomes progressively degraded.

Typical rollers have a core provided with a covering of elastomeric material, although it is possible for the roller to be elastomeric throughout its cross-section. As the sheet material leaves a given liquid treatment vessel it is necessary to remove any liquid carried on the sheet material as efficiently as possible, to prevent carry-over of liquid into a next treatment vessel and to reduce edge effects which arise from non-homogeneous chemistry on the sheet material after squeegeeing. This applies whether the apparatus is of a horizontal or vertical configuration. To do this job properly, the rollers must exert a sufficient and homogeneous pressure over the whole width of the sheet material. Also, to reduce edge effects, it is desirable that the opposite roller surfaces are in contact with each other beyond the edges of the sheet material. To put this problem in context, rollers used in conventional processing apparatus for example have a length of 400 mm or more and a diameter of from 24 to 60 mm. The sheet material typically has a width of from a few millimetres up to 2 m and a thickness of 0.05 mm to 0.5 mm. In view of the nature of elastomeric material, it is in fact impossible to totally eliminate any gap between the roller surfaces at the edges of the sheet material as it passes through the nip. It is desirable that the roller surfaces be in contact with each other within as short a distance as possible from the edges of the sheet material i.e. that the size of the leak zone should be minimised. It is important however that the force between the rollers is sufficient to prevent leakage when no sheet material is passing through. However, the force must not be so high as to risk physical damage to the sheet material as it passes through the nip.

It has been proposed that, in order to equalise the pressure applied by the rollers to the sheet material across the width thereof, the rollers should not have an exactly cylindrical configuration, but rather the roller should be provided with a radial dimension profile which varies along the length thereof. This may be achieved by grinding the elastomer to provide the roller with the predetermined profile. However, grinding of the elastomer can only be carried out successfully if it is sufficient hard. The use of different rollers for different purposes is costly and introduces engineering problems into the design of the apparatus.

OBJECTS OF INVENTION

It is an object of the present invention to provide a roller which is able to minimise carry-over between vessels of a processing apparatus without damage to the sheet material while being capable of successfully being used as a drive roller.

SUMMARY OF THE INVENTION

We have now discovered that this objective may be realised by a specific construction of the processing rollers, in particular where the roller comprises at least two regions of different hardness and furthermore that similar benefits can be obtained with rotatable surface means other than rollers, such as drive belts.

Thus, according to a first aspect of the invention, there is provided an apparatus for the wet processing of photographic sheet material comprising at least one treatment vessel having a rotatable endless surface means biased towards a reaction member to define a nip there-between through which a sheet material path extends, characterised in that at least one of the endless rotatable surface means and the reaction member comprises an inner region of elastomeric material having a relatively low hardness, and an outer region of elastomeric material having a relatively high hardness positioned over the inner region.

The rotatable endless surface means may be a roller, such as a squeegee roller, but may also be formed by a drive belt, or any other rotatable endless surface means intended for use in photographic sheet material processing apparatus. Where this general description refers to a roller, it is to be understood that similar remarks also apply to other rotatable endless surface means such as a drive belt, except where the context demands otherwise.

The reaction member towards which the roller is biased to define the nip will usually be another roller. It is however also possible for the reaction member to be in the form of a belt or a fixed surface. Where this general description refers to the use of two rollers, it is to be understood that the second roller may be replaced by any other reaction surface, such as those referred to above.

The two regions of elastomeric material will usually be constituted by distinguishable layers, but it is also within the scope of this invention to use a single layer of elastomeric material which is so formed to have a hardness which varies throughout its thickness.

It is preferred that both the endless rotatable surface means and, the reaction member comprise the inner region of elastomeric material having a relatively low hardness, and the outer region of elastomeric material having a relatively high hardness positioned over the inner region. Indeed, it will be usual for two identical rollers to be used. However, it is possible for the reaction surface to be formed by a second roller which is not so constructed, such as for example, a roller or other reaction member having no elastomeric covering.

In preferred embodiments of the invention, the roller further comprises a rigid core, the inner region being an intermediate layer positioned over the core. The provision of a rigid core enables drive to be transmitted to the roller in a convenient manner.

However the provision of a rigid core is not essential, it being possible to drive the roller externally, by frictional contact between the outer surface of the roller and suitable drive means, such as separate drive rollers.

The Shore-A hardness of the inner region may be less than 50, preferably from 15 to 45, while the Shore-A hardness of the outer region may be more than 25, preferably from 40 to 90. Where the inner and outer regions are constituted by distinguishable layers, the difference between the Shore-A hardness of the inner layer and the outer layer may be at least 5, most preferably at least 10. Elastomeric materials having a low Shore-A hardness provide elastomeric properties consistent with the objective of low carry-over, but low molecular weight compounds tend to diffuse in use into the treatment baths so that these elastomeric properties are lost while both chemical and physical wear resistance are low. The provision according to the invention of the outer region of elastomeric material having a higher Shore-A hardness reduces these negative effects, surprisingly without significantly increasing carry-over and enables grinding to a desired surface quality. More specifically, optimal grinding of the elastomeric material improves the hydrophilicity of the material by stabilising its surface roughness and also reduces the torque required to drive the roller by lowering its rolling resistance. The use of elastomeric materials with relatively high hardness improves the stability to oxygen and ultra violet light, reduces evaporation of elastomeric compounds from the surface and reduces the diffusion of treatment liquids through the material. The performance and useful life of the roller can therefore be optimised.

Where the inner and outer regions are constituted by distinguishable layers, the inner layer may have a thickness which may be from 5% to 35%, such as from 10% to 20% of the roller diameter, that is at least 1.0 mm, such as from 4 mm to 8 mm for a typical roller having a diameter of 40 mm. The outer layer may have a thickness which may be from 1% to 10% of the roller diameter, that is at least 0.2 mm for the typical roller. Below this thickness, the elastomeric effect may be lost, and grinding to a desired profile becomes difficult or impossible.

Preferably, the core has a flexural E-modulus of between 50 GPa and 300 GPa. Suitable materials for the rigid core include metals, such as stainless steel, non-ferrous alloys, titanium, aluminium or a composite thereof. In one embodiment of the invention, the core is hollow. Alternatively the core may be solid.

The elastomeric materials which are used for the inner and outer regions may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber and, particularly for the outer region, such materials doped with a surface modifying material selected from PTFE (poly tetra fluoro ethylene) particles, carbon fibres, glass fibres, glass beads and mixtures thereof to modify the surface thereof by reducing wear, lowering friction and enabling self-cleaning.

Although it is possible to add further layers, usually no other layers will be present, so that the inner layer is directly in contact with the core and with the outer layer, although it should be noted that the core may be treated with a primer or adhesive to ensure good bonding with the inner layer of elastomeric material.

According to a second aspect of the invention, there is provided a method of forming a roller for use in a photographic sheet material processing apparatus, comprising the steps of forming the intermediate layer of relatively low hardness over a rigid core, and thereafter forming the outer layer of relatively high hardness over the intermediate layer.

In the method according to the invention, the inner layer may be formed by various techniques depending upon the nature of the elastomeric material, for example by pressure-less moulding or by vulcanising at an elevated temperature. In the case of polyurethane for example, pressure-less moulding is a suitable technique, optionally followed by machining to ensure the desired profile. In the case of EPDM, a primer may be applied to the core to act as an adhesive and non-vulcanised EPDM applied thereto. By winding a plastic tape tightly over the EPDM it is possible to squeeze out any excess air. The assembly is placed in an autoclave under pressure and at an elevated temperature in the presence of a vulcanising agent to ensure vulcanisation. After cooling, the intermediate layer may be ground to the desired profile. Alternatively the intermediate layer may be formed by using a hollow tube of vulcanised material and inserting the tube over a slightly over-sized core while applying air pressure to the hollow interior of the tube to ensure a tight fit once the air pressure is released. In yet a further alternative, non-vulcanised material of the intermediate layer may be moulded in situ on the core followed by vulcanisation in an autoclave.

The outer layer may be formed by similar methods or by placing a sleeve of relatively high hardness material over the inner layer.

It is preferred that the outer, relatively hard, elastomeric material extends over the end faces of the inner, relatively soft, elastomeric material, to reduce or prevent degradation of the latter on exposure to treatment liquids. Alternatively or additionally, end flanges may be provided to close off and protect the ends of the intermediate material layer, but this is a less preferred construction.

In a preferred embodiment of the invention, that portion of the outer layer which extends over the end face of the inner layer is so shaped as to provide a space into which into which the elastomeric material of the covering may be deformed as a result of a sealing force between the roller and a sealing surface of the apparatus. Alternatively, the sealing surface may be provided with a space for the same purpose. The outer layer may be formed in two parts. A first part may extend over the end face of the inner layer while a second part extends along the outer surface of the roller. The first part may usefully include a friction reducing component, such as PTFE, to reduce the friction between the roller and the sealing surface of the apparatus, while the second part is best without this component being present. The two parts of the outer layer may be formed by separate vulcanisation steps.

In use in a photographic sheet material processing apparatus, one roller is positioned parallel to and in contact with another roller to form a squeegee pair. In order to obtain good processing quality it is advantageous for the rollers at the exit of each vessel of the apparatus to exert a load in the order of 0.001 to 1.0 N/mm roller length, preferably 0.025–0.5 N/mm, to remove excess processing materials, the load practically being applied at each end of the rollers. To this end the rollers are biased together, for example, by making use of the intrinsic elasticity of the elastomeric material by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

In a particular embodiment of the invention, the inner and/or the outer layer has a variable thickness to provide the roller with a radial dimension profile which varies along the length thereof. This may be achieved by grinding the respective layer to provide the roller with the predetermined profile. As an alternative, the rigid core may be provided with a diameter which varies along the length thereof. It is preferred that both rollers of a roller pair have the same radial dimension profile for ease of manufacturing. Ideally, the radial dimension profile of each roller is such in relation to the biasing force applied to the rollers that the force applied by the rollers to sheet material passing therebetween is substantially even over the width thereof.

The radial dimension of each roller ideally decreases towards the ends thereof i.e. a convex profile, especially a parabolic profile.

Ideally, the radial dimension profile of such a roller is such that the force applied by the roller to sheet material passing through the nip is substantially even over the width thereof.

In a preferred embodiment of the invention, the rollers are substantially equal in length. One or both of the rollers may constitute drive rollers for driving the sheet material along the sheet material path. Alternatively, the rollers may be freely rotating, alternative drive means being provided to drive the photographic sheet material through the apparatus.

The invention is applicable both to apparatus comprising a plurality of treatment vessels, so arranged to define a substantially horizontal sheet material path through the apparatus, and to an apparatus comprising a plurality of treatment vessels, so arranged to define a substantially vertical sheet material path through the apparatus.

DETAILED DESCRIPTION OF THE INVENTION

The invention will be described by the following illustrative embodiments with reference to the accompanying drawings without the intention to limit the invention thereto, and in which.

Figure 1:
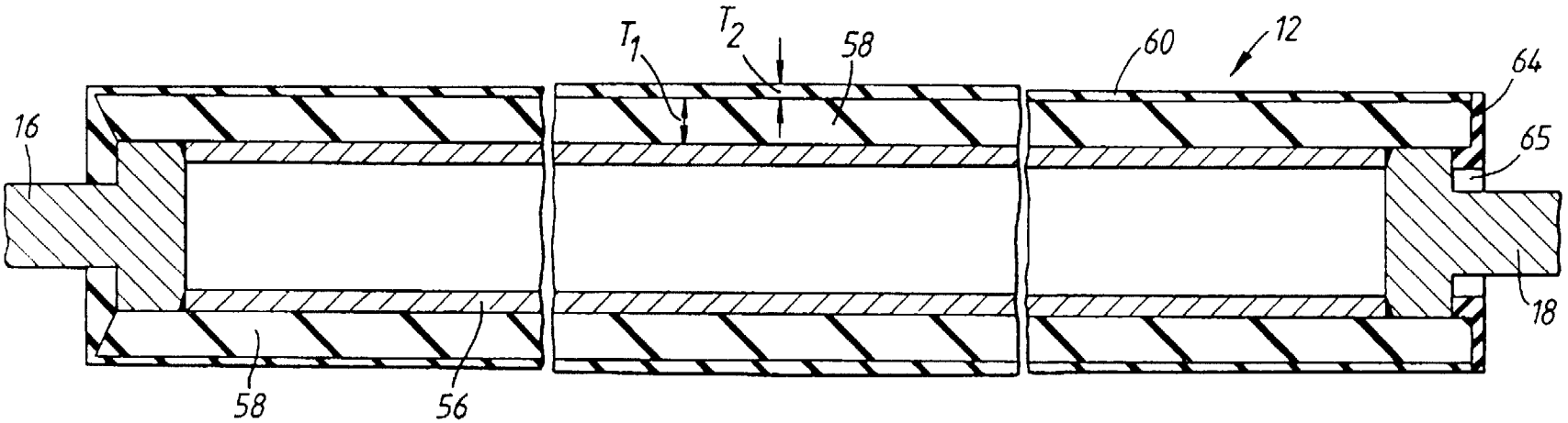
FIG. 1 is a cross-sectional view of a processing roller suitable for use in a horizontal photographic material processing apparatus.

Referring to FIG. 1, which is not drawn to scale, a roller 12 comprises a stainless steel rigid core 56, an inner or intermediate layer of elastomeric material 58 positioned over the core, and an outer layer of elastomeric material 60 positioned over the intermediate layer. No other layers are present, so that the intermediate layer 58 is directly in contact with the core and with the outer layer 60.

In the described and illustrated embodiment, the core 56 is in the form of a hollow stainless steel cylinder having an outside diameter of 25 mm and a wall thickness of 3 mm.

The intermediate layer 58 has a thickness $T_1$ of 6.5 mm (amounting to about 16% of the roller diameter) and is formed of EPDM having a Shore-A hardness of 24.

The outer layer 60 is also formed of EPDM, but in this case the Shore-A hardness is 50. The outer layer 60 has a variable thickness $T_2$ to provide the roller with a radial dimension profile which varies along the length thereof.

To form the roller shown in FIG. 1, the intermediate layer 58 is formed over the rigid core by coating an adhesive primer on the core and then applying non-vulcanised EPDM thereto. A plastic tape is then tightly applied over the EPDM to squeeze out any excess air. The assembly is placed in an autoclave at a pressure of 6 to 7 bar and at a temperature of 160° to 180° C. for 1 to 2 hours in the presence of sulphur or a peroxide, to ensure vulcanisation. After removing the assembly from the autoclave and cooling, the intermediate layer 58 is ground to the desired profile. Thereafter, the outer layer 60 is formed by a similar process, followed by machining to ensure the desired profile, in this example a parabolic profile where the thickness of the outer layer 60 varies from 0.5 mm at each end of the roller to 1.0 mm in the centre of the roller, thereby giving an overall roller diameter which varies from 39 mm at the ends to 40 mm at the centre. The roller typically has a length of 850 mm.

FIG. 1 illustrates two possible embodiments of the invention. As shown at the right hand end of FIG. 1, a separate portion 64 of the outer layer extends over the end face of the inner layer 58. This construction is particularly suitable when the outer layer is formed of EPDM, the end part 64 including PTFE as a friction reducing component to reduce the friction between the roller and the sealing surface of the apparatus. The portion 64 is so shaped as to provide a space 65 into which the elastomeric material of the covering may be deformed as a result of a sealing force between the roller and a sealing surface of the apparatus. In this embodiment, the outer layer is thus formed in two parts, namely a part 60 which extends along the outer surface of the roller and another part 64 which extends over the end face of the inner layer 58. The two parts of the outer layer may be formed by separate vulcanisation steps.

In the embodiment shown at the left hand end of FIG. 1, the outer region 60 itself extends over the end face of the inner layer 58. This construction is particularly suitable when the outer layer of elastomeric material is formed of polyurethane.

In both these embodiments, shafts 16, 18 are suitably welded to the end of the core 56, or are integral therewith.

Whatever construction is used for the ends of the roller, it is advantageous to mask the intermediate layer 58 from processing liquids used in the apparatus in which the roller is incorporated, so as to reduce chemical attack on the more chemically sensitive material of the intermediate layer.

Figure 2:
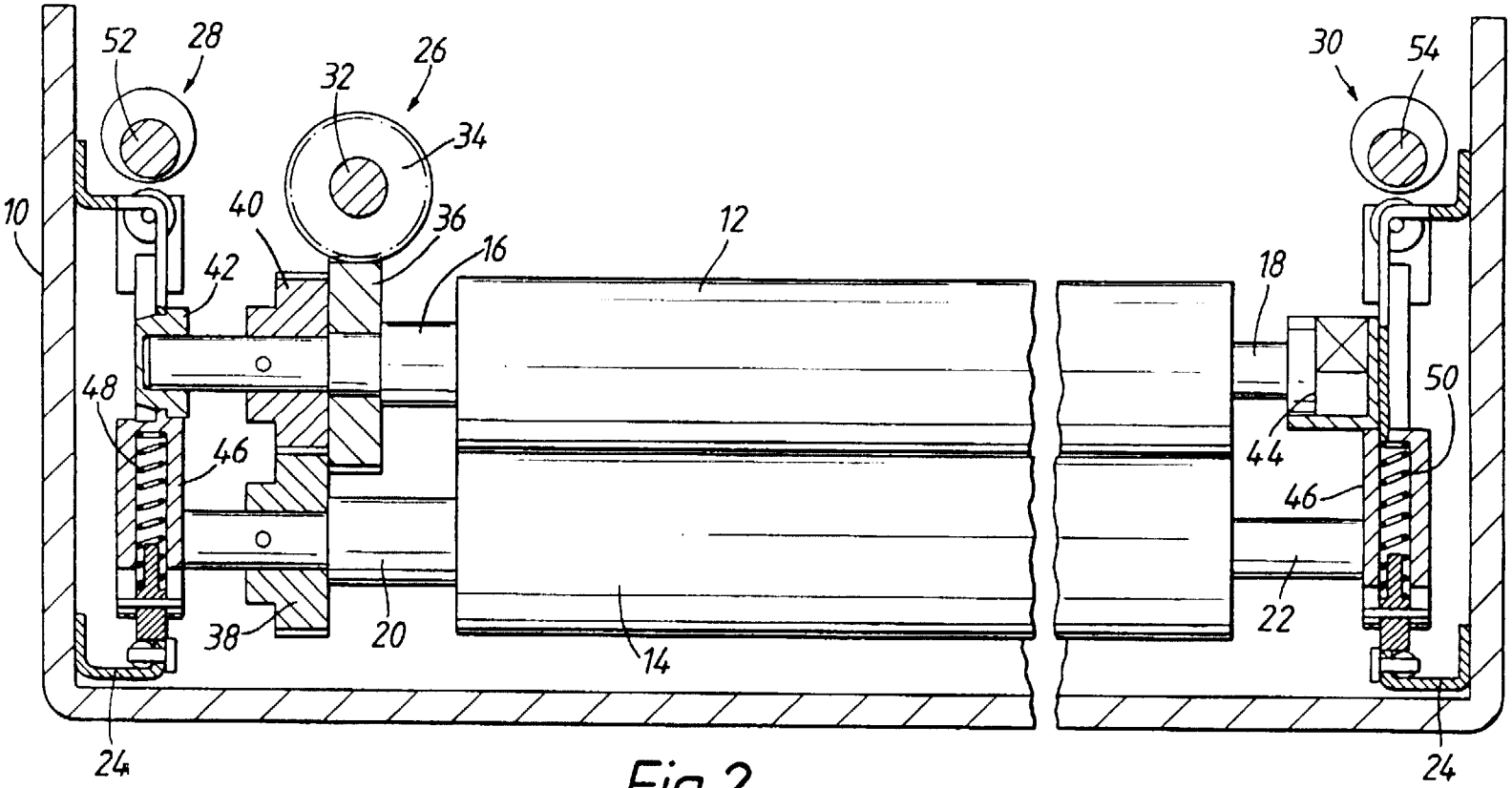
FIG. 2 is an elevational view of part of a horizontal photographic material processing apparatus according to the present invention, using processing rollers as shown in FIG. 1.

Referring to FIG. 2, part of a photographic sheet material processing apparatus, of the type described in EP-A-410500 referred to above, is shown. The processing apparatus is mounted within a generally rectangular housing 10 which may include a rectangular metal mainframe (not shown in FIG. 2 for the sake of clarity) for supporting the various sections of the apparatus. The apparatus includes a number of treatment vessels, sheet material to be processed being passed from one vessel to the next by squeegee roller pairs, which also serve as drive rollers. One such roller pair is shown in FIG. 2, namely an upper squeegee roller 12 and a lower squeegee roller 14. The upper roller 12 is constructed as shown in FIG. 1. The lower roller 14 is similarly constructed. The rollers 12 and 14 are positioned substantially parallel and in line contact with each other. The upper roller 12 is fixed on respective shafts 16 and 18 for rotation and the lower roller 14 is fixed on respective shafts 20 and 22 for rotation. The roller shafts 16, 18, 20, 22 are mounted at each end in bearings held in respective sub-frames 24.

A drive device 26 for the rollers comprises a mechanical transmission for driving said processing roller 12 and a set of cooperating gears located at one end and at the same side of both roller shafts 16, 20. The upper processing roller 12 is driven at one end thereof through a worm-screw 34 and a worm-wheel 36 by a drive shaft 32, which links all upper rollers in the apparatus. The lower processing roller 14 is driven by a helical gear 38 which meshes with another helical gear 40. The drive shaft 32 is driven preferably by an electric motor with an encoding disc system (not shown) in order to control the speed and the progressing horizontal position of the sheet material.

The coordinates of the upper processing roller 12 are defined by the end bearings 42 and 44. The lower roller 14 rotates in two bearing plates 46 which slide vertically in guides (not shown) in the sub-frames 24 so that the lower roller 14 is free to move towards and away from the upper roller 12.

The roller shafts are biased towards each other to exert a pressure on the photographic sheet material as it passes between the rollers. Compression springs 48, 50 bias the lower roller 14 towards the upper roller 12 by a force of up to 400 N at a roller length of about 850 mm.

The profile of roller 12 is such that, where the lower roller 14 is similarly constructed and a biasing force of 380 N/850 mm is applied by the springs 48 and 50, the force applied by the rollers to an aluminium lithographic sheet material having a thickness of 0.1 to 0.4 mm passing between the rollers is substantially even over the width thereof.

A roller displacement device generally indicated by reference 28 and 30 is also shown. The camshafts 52, 54 are each driven by a synchronised electric motor with an encoding disc system (not shown) in order to control the vertical displacement of the displaceable processing roller 14.

Figure 3:
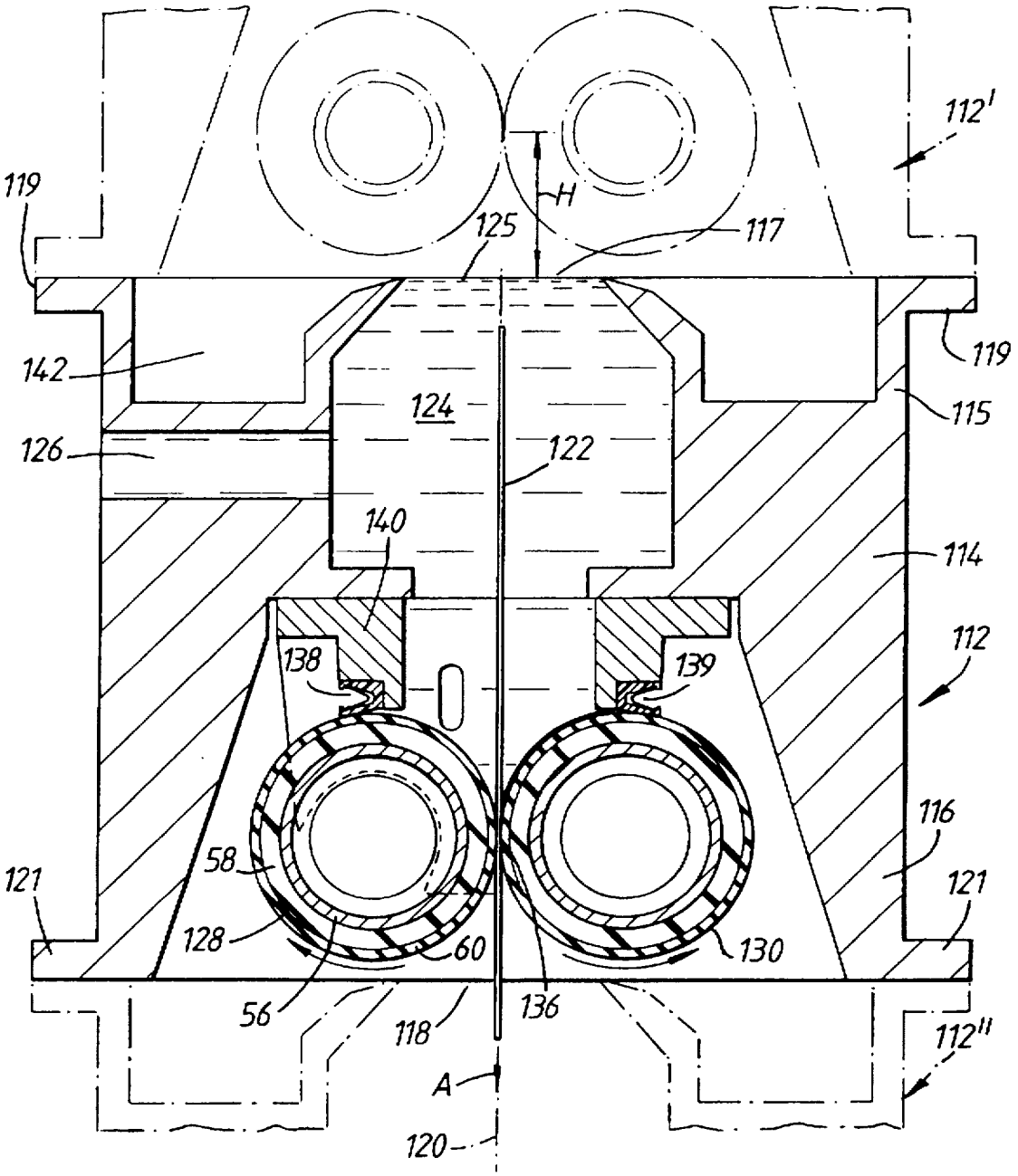
FIG. 3 is, in solid lines, a cross-sectional view of one vessel of a vertical processing apparatus according to the invention, with adjacent vessels being partly shown in broken lines.

The rollers illustrated in FIG. 1 are also suitable for use in a vertical processing apparatus, one embodiment of which is shown in FIG. 3. As shown in FIG. 3, each vessel 112 comprises a housing 114 which is of generally rectangular cross-section and is so shaped as to provide an upper part 115 having an upper opening 117 and a lower part 116 having a lower opening 118. The upper opening 117 constitutes a sheet material inlet and the lower opening 118 constitutes a sheet material outlet. The inlet and outlet define there-between a substantially vertical sheet material path 120 through the vessel 112, the sheet material 122 moving in a downwards direction as indicated by the arrow A. The sheet material preferably has a width which is at least 10 mm smaller than the length of the nip, so as to enable a spacing of at least 5 mm between the edges of the sheet and the adjacent limit of the nip, thereby to minimise leakage. Each vessel 112 may contain treatment liquid 124, a passage 126 in the housing 114 being provided as an inlet for the treatment liquid 124. The lower opening 118 is closed by a pair of rotatable rollers 128, 130 carried in the apparatus.

Each roller 128, 130 is of the squeegee type as illustrated in FIG. 1, comprising a stainless steel hollow core 56 carrying inner and outer elastomeric coverings 58, 60. The rollers 128, 130 are biased towards each other with a force sufficient to effect a liquid tight seal but without causing damage to the photographic sheet material 122 as it passes there-between. The line of contact between the rollers 128, 130 defines a nip 136. The rollers 128, 130 are coupled to drive means (not shown) so as to constitute drive rollers for driving the sheet material 122 along the sheet material path 120.

In the illustrated embodiment, each roller 128, 130 is in sealing contact along its length, with a respective stationary sealing member 138, 139 carried on a sealing support 140, which in turn is secured to the housing 114 of the vessel 112, the treatment liquid 124 being retained in the vessel 112 by the rollers 128, 130 and the sealing members 138, 139. The sealing members 138, 139 are formed of PTFE and have a composite structure. The sealing members 138, 139 are secured to the sealing support 140 by a suitable, water- and chemical-resistant adhesive, such as a silicone adhesive. By the use of a material of relatively high hardness for the outer layer 60 of the rollers, the wear resistance between the surface of the rollers and the sealing members 138, 139 is reduced.

The upper and lower housing parts 115, 116 are provided with flanges 119, 121 respectively to enable the vessel 112 to be mounted directly above or below an identical or similar other vessel 112', 112", as partly indicated in broken lines in FIG. 3. The upper housing part 115 is so shaped in relation to the lower housing part 116 as to provide a substantially closed connection between adjacent vessels. Thus, treatment liquid from vessel 112 is prevented from falling into the lower vessel 112" by the rollers 128, 130 and sealing members 138, 139, while vapours from the lower vessel 112" are prevented from entering the vessel 112 or escaping into the environment. This construction has the advantage that the treatment liquid in one vessel 112 is not contaminated by contents of the adjacent vessels and that by virtue of the treatment liquids being in a closed system evaporation, oxidation and carbonization thereof is significantly reduced.

The upper part 115 of the housing 114 is so shaped as to define a leakage tray 142. Any treatment liquid which may pass through the roller nip of the next higher vessel 112', in particular as the sheet material 122 passes therethrough, drips from the rollers of that vessel and falls into the leakage tray 142 from where it may be recovered and recirculated as desired. The distance H between the surface 125 of the liquid 124 and the nip of the rollers of the next upper vessel 112' is as low as possible.

We claim:

1. An apparatus for the wet processing of photographic sheet material comprising at least one treatment vessel having a rotatable endless surface means biased towards a reaction member to define a nip there-between through which a sheet material path extends, wherein at least one of the rotatable endless surfaces means and the reaction member comprises an inner region of elastomeric material having a relatively low hardness, and an outer region of elastomeric material having a relatively high hardness positioned over the inner region, the difference between the Shore-A hardness of said inner region and said outer region being at least 5.

2. An apparatus according to claim 1, wherein the Shore-A hardness of said inner region is less than 50.

3. The apparatus of claim 2, wherein the Shore-A hardness of the inner region is less than 20.

4. An apparatus according to claim 1, wherein the Shore-A hardness of said outer region is more than 25.

5. An apparatus according to claim 1, wherein said inner region is formed of an elastomeric material selected from ethylene/propylene/diene terpolymers, silicone rubber, polyurethane, thermoplastic rubber, styrene-butyl rubber and nitrile-butyl rubber.

6. An apparatus according to 1, wherein said outer region is formed of an elastomeric material selected from ethylene/propylene/diene terpolymers, silicone rubber, polyurethane, thermoplastic rubber, styrene-butyl rubber, nitrile-butyl rubber and such materials doped with a surface modifying material selected from PTFE particles, carbon fibres, glass fibres, glass beads and mixtures thereof.

7. An apparatus according to claim 1, comprising a plurality of said treatment vessels, so arranged to define a substantially horizontal sheet material path through the apparatus.

8. An apparatus according to claim 1, comprising a plurality of said treatment vessels, so arranged to define a substantially vertical sheet material path through the apparatus.

9. An apparatus according to claim 1, wherein said endless rotatable surface means is constituted by a roller.

10. An apparatus according to claim 9, wherein said roller comprises a rigid core formed of a material selected from stainless steel, non-ferrous alloys, titanium, aluminium and composites thereof.

11. An apparatus according to claim 9, wherein said reaction member is constituted by a further roller.

12. The apparatus according to claim 1, wherein the difference between the Shore-A hardness of the inner region and the outer region is at least 10.

13. The apparatus of claim 12, wherein the Shore-A hardness of said inner region is less than 50.

14. The apparatus of claim 13, wherein the Shore-A hardness of the inner region is less than 20.

15. The apparatus of claim 1, wherein said inner region is formed of an elastomeric material selected from ethylene/propylene/diene terpolymers, polyurethane, thermoplastic rubber, styrene-butyl rubber and nitrile-butyl rubber.

* * * * *